US005361693A

United States Patent [19]

Farb et al.

[11] Patent Number: 5,361,693

[45] Date of Patent: Nov. 8, 1994

[54] TUNGSTEN CARBIDE WELDED PRINTER TIPS

[75] Inventors: Norman E. Farb, Villa Park; James Chon, Pomona, both of Calif.

[73] Assignee: Printronix, Inc., Irvine, Calif.

[21] Appl. No.: 987,379

[22] Filed: Dec. 8, 1992

[51] Int. Cl.[5] ..... B41J 2/26

[52] U.S. Cl. ..... 101/93.04; 400/124.32; 219/78.01

[58] Field of Search ..... 101/93.04, 93.05, 93.48; 400/121, 124, 124 WD; 219/78.01, 85.16, 78.13, 86.23, 86.25, 86.31, 90, 91.22

[56] References Cited

U.S. PATENT DOCUMENTS 1,645,710 10/1927 Meadowcroft ..... 219/86.31
4,134,691 1/1979 Matschke ..... 400/124
4,503,768 3/1985 Whitaker ..... 101/93.04
5,093,547 3/1992 Kusano et al. ..... 219/78.13

*Primary Examiner*—David A. Wiecking
*Attorney, Agent, or Firm*—George F. Bethel; Patience K. Bethel

[57] ABSTRACT

A process and apparatus for welding a tungsten carbide printing tip of a dot matrix printer to a hammerspring by holding the hammerspring in a fixture with a first electrode in adjacent relationship thereto and a second electrode in adjacent relationship to a tungsten carbide printing tip having cobalt and forcing said tungsten carbide printing tip into adjacent relationship with said hammerspring while causing cobalt in said tungsten carbide printing tip to be welded to said hammerspring through a welding current between said first and second electrodes.

3 Claims, 2 Drawing Sheets

Fig. 4
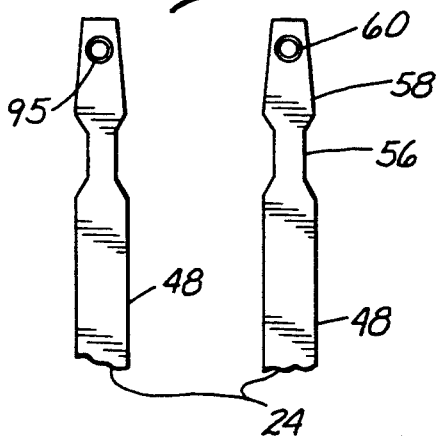
Fig. 6
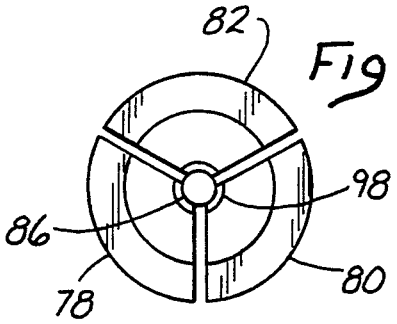
Fig. 5
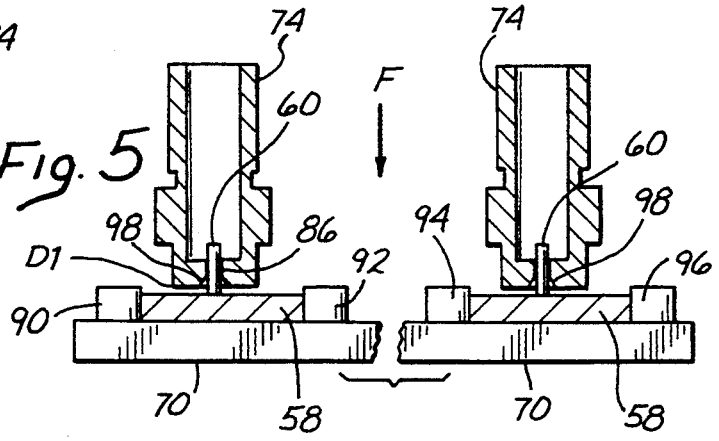
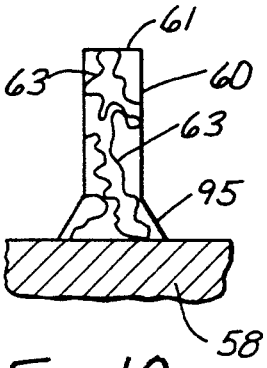
Fig. 10
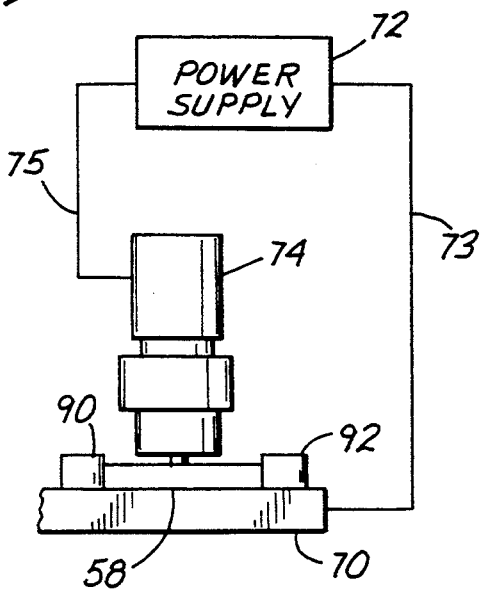
Fig. 7
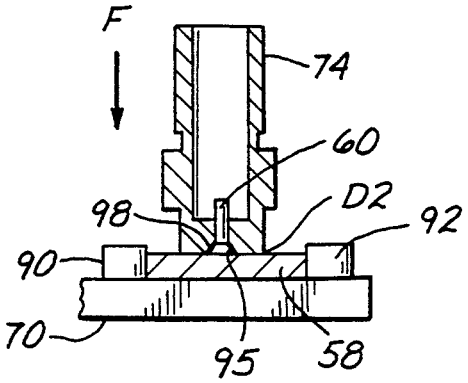
Fig. 9
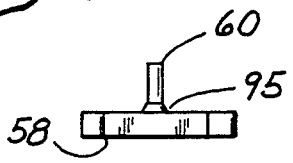
Fig. 8

TUNGSTEN CARBIDE WELDED PRINTER TIPS

FIELD OF THE INVENTION

This disclosure relates to impact dot matrix line printers. Such printers are known to have hammersprings in a bank. The hammersprings are released from a permanent magnet by overcoming the field of the permanent magnet through an electrical coil. The hammersprings generally have tips which are made of a tungsten carbide rod. These tips are secured to the hammersprings. This application specifically relates to the securement of such tips to the hammersprings.

BACKGROUND OF THE INVENTION

Dot matrix impact line printers have been designed over the years to provide for dots in a matrix configuration to form alphabetical and numerical symbols. Such printers can generally be described as having hammersprings with a tip. The tip at the end of each hammerspring is formed oftentimes from a tungsten carbide rod. The tungsten carbide rod is extremely hard and durable.

Such dot matrix printers can be exemplified by the patents assigned to the assignee of this invention, namely Printronix, Inc. An example of such technology can be seen in U.S. Pat. No. 3,941,051.

In these types of printers, the hammersprings historically have been formed of a uniform spring such as a leaf spring. At the end of the leaf spring, a tip or rod is fitted and brazed into an opening of the spring. Before brazing, the tungsten carbide rod is pressed into the steel base of the spring and then brazed to the spring steel.

The reliability of a brazing process in combination with a pressed fit although extremely functional over the years has been obviated by this invention. This specific invention utilizes a resistance welding process of the tungsten carbide to the steel in a superior manner by resistance welding.

The method of welding when combined with the hammersprings of this invention and the tungsten carbide tips becomes a unique process for today's printers to provide high speed, high durability and substantial reliability which is not known in the art.

Further to this invention, is a hammerspring that is configured to provide for extremely effective impact by utilizing the full capability of the mass of the spring and its spring potential.

The respective process for welding the tungsten carbide rod to the steel base of the spring steel of the hammerspring is accomplished by utilization of the cobalt in the tungsten carbide. The cobalt in the tungsten carbide flows in a manner to provide for a weld which is superior to that in the prior art. It particularly flows so as to create a weld and maximizes the connection through an enhanced and broadened base fillet or gusset to the weldment.

The parameters of the welding process include an appropriate electrode design, a welding program, as well as a certain amount of mechanical force by the electrode, and the respective cooling in adjacent relationship to the electrode.

The tungsten carbide rod or tip can be of any suitable size and shape. The steel of the spring can be any low carbon steel or low alloy steel. The net result is to achieve a significant bonding between the tungsten carbide rod or tip and the hammersprings of this invention for improved operation.

An enhanced feature of this invention is the hammerspring configuration in conjunction with the welded rod or tip. This particular hammerspring configuration in conjunction with the welded rod allows for significantly higher operating speeds as well as long life and durability. As a consequence, it is believed that the method and apparatus as provided by the teachings of this invention are a significant step over the prior art.

SUMMARY OF THE INVENTION

In summation, this invention provides for a new hammerspring for an impact printer having a tungsten carbide tip welded thereto through an improved process that provides for an end product that is an inventive step over the state of the art.

More specifically, the invention hereof provides for an emplacement of a tungsten carbide rod in an electrode. The electrode is forced with the rod in to juxtaposition with a steel base or spring steel hammerspring. The spring steel hammerspring, is clamped and maintained in a fixed location with appropriate heat sinks to allow for heat dissipation during the welding process.

The welding process takes place by the electrode which is formed as a combination electrode and clamp, holding the tip in direct juxtaposition to the spring steel. Under a given pressure, the tungsten carbide tip is held to provide for a flow under a resistance welding process through the cobalt matrix or strands forming a filigree in the tungsten carbide.

The pressure during the welding process as the current flows causes the tip at the interfacial area of the tip between the tungsten carbide and the spring to deform under pressure so that a fillet or gusset is formed to provide for a reinforcement. During this welding process, the heat generated is dissipated through a heat sink while at the same time the hammersprings are maintained in a degree of rigidity so as to prevent deformation while at the same time normalizing them in to proper alignment.

A unique characteristic of the cobalt strands or filigree is that the cobalt forms a resistance that becomes self limiting after deformation. This is due to an increased area formed by the cobalt at its base or gusset.

The foregoing objects and advances over the art will become more apparent through a reading of the following specification taken in conjunction with the drawings in reference thereto.

BRIEF DESCRIPTION OF THE DRAWINGS

FIG. 4 shows a frontal view of the hammersprings of this invention with the tungsten carbide tips.

FIG. 5 shows the electrode clamps of this invention holding in juxtaposition the respective tungsten carbide tips and hammersprings in the form of a sectional view.

FIG. 6 shows a view looking upwardly at the electrode clamp and a tungsten carbide tip held thereby.

FIG. 7 shows a schematic diagram of the welding electrodes of this invention during the welding process securing the tips in their welded condition to the hammersprings of this invention.

FIG. 8 shows the tip welded to the hammerspring with a fillet in the final resulting product of the welded tip and the hammerspring.

FIG. 9 shows a sectional view similar to FIG. 5 after the welding process has taken place.

FIG. 10 shows a sectional view of the tip of this invention connected to a hammerspring showing the cobalt, tungsten carbide matrix.

DETAILED DESCRIPTION OF THE SPECIFICATION

Figure 1:
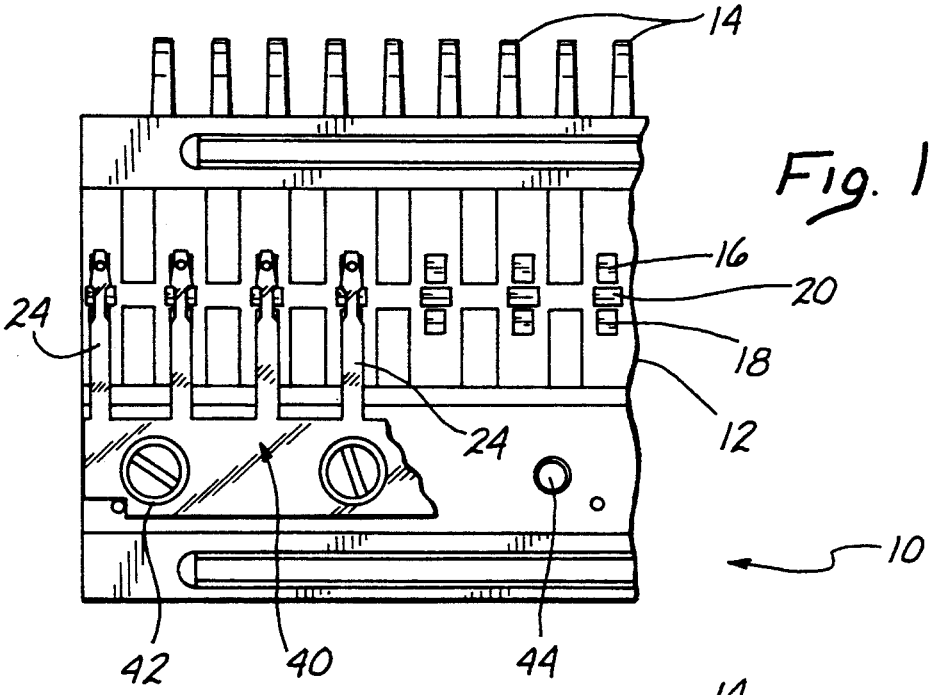
FIG. 1 shows a dot matrix impact line printer hammerbank of this invention in a front elevation fragmented view showing the respective hammersprings, print tips, and magnets securing said hammersprings as seen from the direction of the paper to be printed upon.
Figure 2:
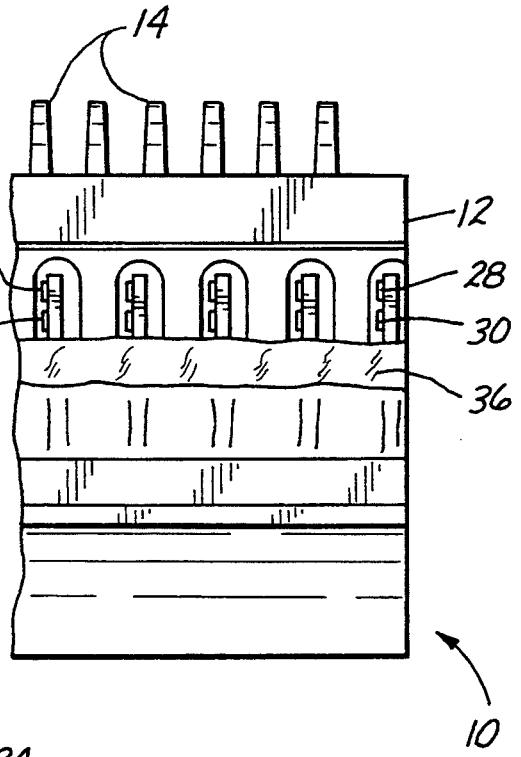
FIG. 2 shows a rear elevation fragmented view of the hammerbank of this invention with the terminals for the coils that overcome the permanent magnets to release the hammers.
Figure 3:
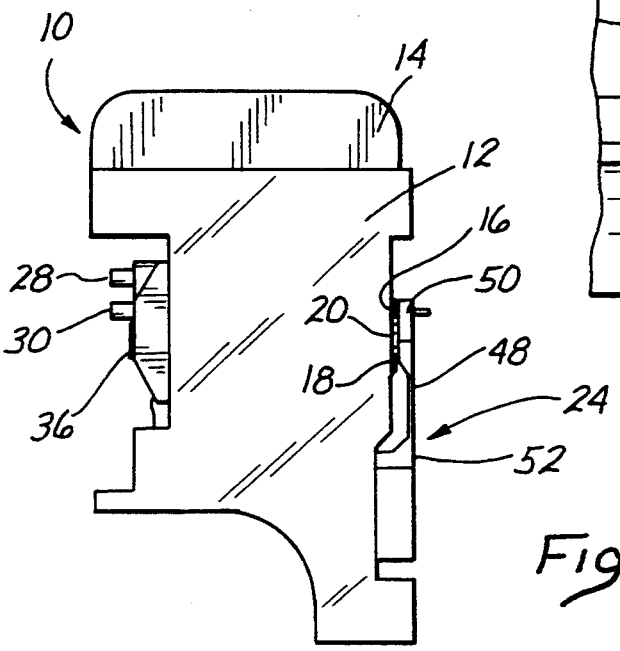
FIG. 3 shows a side elevation view of the hammerbank of this invention, as seen from the left side of FIG. 1.

Looking particularly at FIGS. 1, 2, and 3, it can be seen that a printer hammerbank 10 has been shown. The printer hammerbank 10 incorporates a frame or framework 12. The frame or framework 12 is formed from a metal casting and/or can be machined in any suitable way so as to provide for the magnetic and support functions for the hammersprings.

In conjunction with the framework 12, a series of fins 14 are formed. The fins 14 provide heat dissipation and a respective heat sink necessary for improved operation.

The framework 12 is such wherein it has been machined, milled or configured in any suitable manner so as to provide a number of through holes for the emplacement of magnets with pole pieces.

The magnets which are partially hidden in the framework 12 with pole pieces can be seen having magnetic poles 16 and 18 extending from the framework. The magnetic poles 16 and 18 are divided by a magnetic insulator or wear bar 20 made of inconel which in turn interact with hammersprings 24. The inconel block 20 serves the function of a wear bar or raised impact surface by allowing the hammersprings 24 as defined hereinafter to impact the wear bar or raised impact surface 20 rather than the poles 16 and 18. This is due to the wear bar or raised impact surface 20 extending slightly beyond the end surfaces of the pole pieces 16 and 18. In operation, the hammersprings 24 impact the wear bar 20 and leave a gap between the surface of the hammersprings and the ends of the pole pieces 16 and 18.

Each pole piece 16 and 18 is placed in alignment within the framework 12 so as to provide for a plurality of pole pieces 16 and 18 to hold and magnetically release a number of hammersprings 24. The hammersprings 24 can be seen in greater detail in FIG. 4 which will be amplified upon.

The pole pieces 16 and 18 are formed of a magnetic alloy so that permanent magnetism can be established by them at the tips of the poles 16 and 18. This magnetism at the tips of the poles 16 and 18 is such wherein it holds the hammersprings 24 into close juxtaposition to the pole pieces until they are released by means of electrical coils overcoming the permanent magnetic forces.

The electrical coils are wound around the respective pole pieces as detailed in those patents assigned to the assignee hereof.

The release of the hammersprings 24 by means of electrical windings overcoming the permanent magnetism at the poles 16 and 18 is accomplished by connection to a current or voltage source provided at the terminals 28 and 30. Terminals 28 and 30 are in the rear or left hand side view as shown in FIG. 3 of the framework 12. These terminals 28 and 30 are connected to a power source sufficient to provide for the coils wrapped around the permanent magnetic pole pieces 16 and 18 to overcome the permanent magnetic force thereby releasing the hammersprings 24.

In order to bleed off transients and to overcome any electrical noise, a ground strip 36 is provided. This ground strip 36 allows for any transients to be bled so that improper firing and untimely transients will not change the quick firing mechanism provided by the electrical input at the terminals 28 and 30 for releasing the hammersprings 24.

The hammersprings are formed in frets having a plurality of hammersprings. One of these frets is shown as fret 40 having four hammersprings 24 shown connected to the framework 12. This fret 40 is secured to the framework 12 by means of screws 42. These screws 42 secure the fret 40 to the framework 12 by being threaded into tapped openings 44 of the framework 12. Thus, a plurality of frets 40 can be threaded to the framework 12 along the base thereof allowing for a plurality of hammersprings 24 to be secured and released with respect to the magnetic action of the pole pieces 16 and 18.

The frets 40 with the hammersprings 24 are milled from a single piece of spring steel which has been properly treated. The milling is through the cross-sectional view or side view as shown in FIG. 3. This milling process removes the mid-sectional area which is thinner than the other portions of the hammerspring so as to provide the reduced area of thickness as seen. This in effect provides the spring portion 48 set forth hereinafter.

The plan view configuration as seen in FIGS. 1 and 4 of the hammersprings is provided by a cutting operation so as to provide for the necked down configuration at position 56 as seen in FIGS. 1 and 4.

The resulting configuration is a hammerspring having a substantially reduced cross-sectional spring portion 48, with an enlarged end portion 50. The cross-sectional portion 48 terminates in an enlarged area 52 to provide for a cantilevered support to the spring portion 48.

The spring portion 48 can be seen in FIG. 4 in the plan view which terminates in the base 52 that has not been shown. Through the spring portion, a reduced plan view portion is shown which is a necked down portion 56 that expands into an enlarged end portion 58 on which the printing tip or rod 60 has been welded in the manner of this invention.

Looking more specifically at the Figures detailing the process hereof it can be seen in FIGS. 5 through 9 that a welding jig and welding system has been provided as schematically shown in FIG. 7.

The system fundamentally provides for a bottom or base electrode 70. The bottom or base electrode 70 is connected to a power supply 72 by line 73. The power supply 72 is in turn connected to a top electrode 74 by line 75. The top electrode 74 is such wherein it can be made from a close tolerance tubular member in order to receive the printing tips 60 therein in the form of the tungsten carbide tips.

In the alternative the top electrode 74 can be such wherein it is formed as a chuck. The chuck can be of the type used such as a three portion chuck shown in FIG. 6 having outer portions 78, 80 and 82 forming arcuate chuck movement members or regions. These chuck movement members 78, 80, and 82 move radially in order to provide for a gripping of the tungsten carbide tip 60 which is the printing tip. The chuck or top electrode 74 can be such wherein it is a speed type chuck of the type used in holding cylindrical or other members for machining by a lathe. In the event the chuck is not used and the top electrode is merely provided with a slip fit receipt of the printing tip 60, the size and shape of the electrode area or opening 86 is quite critical.

In this particular case, when a tungsten carbide rod or printing tip 60 of approximately 0.030 inches is utilized, the clearance between it and the electrode should be 0.0002 inches to 0.001 inches. If it is less than 0.0002 after welding, the top electrode namely top electrode 74 is difficult to withdraw without damaging the printing tip or rod 60. If the gap is more than 0.001, an improper weld joint takes place due to the unstable tungsten carbide rod or tip position in the electrode.

Suffice it to say, when the space 86 is closed down to a nominal space via the gripping of the chuck members 78, 80 and 82, release easily takes place and alignment functions are proper due to the elimination of any gap in the electrode between that and the rod or printing tips 60.

The details of the welding process shall be set forth in the Method of Welding hereinafter. However, in order to understand the apparatus, it should be noted that the welding electrode 74 is formed with the space 86 that can be closed down when it is a chuck or formed in the foregoing manner to provide gaps as detailed.

The top electrode 74 when holding the rod or printing tip 60 impresses it against a single one or a plurality of the hammersprings within the hammerbank when used in plural form. In the plural process a fret 40 of hammersprings 24 is emplaced in a jig formed in part by the welding electrode 70. On top of the welding electrode 70, and in tight juxtaposition to the portions 58 of the hammersprings 24 are a plurality of heat sinks 90, 92, 94, and 96. This plurality of heat sinks 90 through 96 are such wherein they draw off the heat from the welding process so that the portions 58 can be welded without melting or damaging the metallic structure and prior treatment thereof.

The heat sinks 90 through 96 can be such wherein they provide a tightened jig relationship in order to force and hold the hammersprings 24 on the fret 40 into alignment with each other. The net result is to force the hammersprings 24 and the end portions 58 into alignment on the fret 40 so that the plurality of hammersprings are aligned when in associated relationship to the hammerbank 10 and in particular magnetic portions 16 and 18 when attached to the hammerbank.

The formation of the heat sinks 90 through 96 are most important, in order to provide not only the heat dissipation but the hammerspring 24 alignment. Also, it should be understood that the heat sinks and jig portions 90 through 96 are in plural side by side relationship. Any number of hammersprings 24 can be associated between the heat sinks and jig portions in a multiplicity of aligned relationships of hammerspring 24 end portions 58 in alignment with each other in a fret 40 having any plural number of such hammersprings extending therefrom.

The tungsten carbide rod or printing tip 60 is formed of a tungsten carbide having a sixteen percent (16%) cobalt content. The cobalt can be in the range of eight percent (8%) to twenty four percent (24%). The cobalt content is extremely important in providing the weld of this invention. This is due to the fact that the tungsten carbide does not conduct electricity nor melt in the way the cobalt does. The resistance supplied by the cobalt and attendant current flow from the respective electrodes 58 and 74 provide the flow of current necessary to create the weld. The welding function will be detailed hereinafter under the Method of Welding.

The formation of the weldment is created by the impressment of the upper electrode 74 pressing down on the lower electrode 70 with the hammerspring within the jig configuration. This driving down of the electrode 74 against the electrode 58 during the welding process creates a fillet or gusset 95 surrounding the tungsten carbide rod 60 as detailed in FIGS. 8 and 10.

The welding process provided by the electrode 74 and the force applied in the direction of arrow F causes the electrode 74 to move downwardly a given distance. As can be seen in FIG. 5, the distance D1 is the initial space between the electrode 74 and the electrode 58. After welding, and the deformation of the tungsten carbide in the form of the fillet 95, the distance has decreased a distance of D2 which is less than the distance D1 before the weld took place. This distance can be a flush contact between electrode surfaces of electrodes 58 and 74. This is due to the deformation and change of the printing tip 60 so that it deforms and causes the electrode 74 to move downwardly by the force F thereby providing a closer area or space between the respective electrodes 74 and 58. Please bear in mind that the space can be flush between the two respective electrodes 74 and 58. This sometimes enhances the formation of the fillet 95 when formed within or against the adjacent area of the chamfer 98.

Depending upon the force F and the respective amount of cobalt and welding time, the difference in the distance between D1 and D2 can be greater or lesser and as previously stated can be such wherein the electrode 74 moves down adjacent to the electrode 58.

The configuration of the fillet 95 is somewhat shaped by a chamfer 98 within the end of the electrode 74 as well as the self limiting electrical welding resistance of the cobalt in the manner set forth hereinafter. This chamfer 98 is also seen in FIG. 6. The chamfer configuration is shown in approximately a sixty degree (60°) relationship to the horizontal or plane of the electrode 58. It has been found that a range of chamfers from thirty five degrees (35°) through eighty degrees (80°) are sufficient to provide the gusset or fillet as detailed. However, the range of fifty five to sixty five degrees (55–65°) is considered to be one of the more optimum ranges in which to create the weldment of the gusset or fillet 95.

METHOD OF WELDING

The tungsten carbide tip or printing tip 60 can be of any particular size and diameter to form given dot matrix symbols. In this particular situation, it is approximately 0.03 inches in diameter. It is comprised of approximately sixteen percent (16%) cobalt content, the remaining being a tungsten carbide matrix.

The welding of the completely different metals namely the spring steel of the hammersprings 24 and the tungsten carbide printing tips 60 depends upon a relatively careful welding program, electrode force, and cooling. As previously stated, the cooling takes place by the heat sinks 90 through 96 while the electrode force on the electrodes in the welding program shall be described hereinafter.

The fundamental concept of the weld is provided by the carbide and steel being joined together by the heat generated through the resistance and the flow of current by the power supply through the lines 73 and 75. The two respective pieces are held together namely the enlarged end 58 of the hammerspring 24 and the tungsten carbide printing tip 60 by impressment downwardly in the direction of arrow F shown in FIGS. 5 and 9.

The contacting surfaces in the region of current concentration are heated by a short term pulse of low voltage, high current to form a fused relationship. When the flow of current ceases, the electrode mechanical force in the form of force F on the electrode 74 is maintained while the welded material cools. Meanwhile the heat sinks 90 through 96 help to maintain a proper weld relationship.

In order to initiate a weld, the tungsten carbide tip 60 is held in situ within either a fixed electrode or the chuck type electrode 74 shown in FIGS. 5, 6, and 9. The gripping of the tip 60 is initiated and the chamfer 98 is allowed to clear the tungsten carbide printing tip 60 so as to allow for later formation and flow of the gusset or fillet 95. In this particular case, wherein the chamfer 98 is oriented sixty degrees (60°) from the horizontal, it allows for a formation of the gusset or fillet 95 as it approaches and is formed within or against the chamfer.

After gripping the tungsten carbide printing tip 60, the electrode 74 is then driven downwardly in the direction of force F. The force is very important inasmuch as it allows for a deformation of the end of the tungsten carbide printing tip 60 so that the flow of cobalt therefrom can form the gusset or fillet 95. Currently, with a tungsten carbide tip 60 of 0.03 inch diameter rod and a sixteen percent (16%) cobalt content, a mechanical force in the nature of force F is applied in the range of 1.5 to 2.5 pounds. This allows for the tungsten carbide/-cobalt deformation to take place by causing the cobalt to flow outwardly while at the same time providing a weld and the appropriate gusset or fillet 95.

The weld program is initiated with sixty (60) cycle power having an input of two hundred and forty volts (240) to a UNITROL welding transformer by Eaton Manufacturing. In order for a proper weld, the total weld time is eight (8) cycles.

In order to provide the proper weld heat, the voltage input is eighty percent (80%).

To initiate the weld, once the tungsten carbide printing tip 60 is in contact with the electrode 58, under the mechanical force of 1.5 to 2.5 pounds, a preheat function takes place at fifty percent (50%) of total power. The preheat is approximately ten (10) cycles in duration. Thereafter, the previously mentioned eight cycle welding time of eighty percent (80%) takes place.

After welding has taken place, a down cycle is initiated for ten (10) cycles in duration with fifty percent (50%) heat.

The settings providing the foregoing welding currents and voltages will produce a power of 1900 to 2200 watts depending upon the resistance of the tungsten carbide rod or printing tip 60. It has been found that if the power is substantially lower than this, a cold weld will be produced. If the power is substantially higher than this gas pockets can be produced around the weld.

During the welding cycle it is very important to remove the heat from the steel by means of using the heat sinks 90 through 96. These heat sink functions can also be enhanced if desired by liquid or air cooling. It has also been found that a protective gas such as argon during the welding process can enhance the overall weld. However, this has not been found to be necessary to absolutely provide good welds.

The electrical characteristics of the composite as seen in FIG. 10 of tungsten carbide particles 61 surrounded by the strands, elongated streams or filigree of cobalt 63 is used to advantage. The insulating tungsten carbide particles 61 surrounded by the cobalt which acts as the conductor 63 has a higher resistance due to the insulating portions of tungsten carbide.

The volume ratio of the cobalt 63 volume to the tungsten carbide 61 volume plus the cobalt volume reduces the actual cross section area to the product of the volume ratio times the actual cross section. This yields the effective cross-sectional area for resistance calculation purposes. The resulting yield is a higher resistance.

The effective length of the cobalt strands, elongated streams or filigree 63 is also increased because the average path approaches forty five (45) degrees back and forth as one traverses along the length of the tip 60. Thus the resistance length of the tip 60 will be increased by 1/sin45 or 1.4. The volume ratio is in the range of three to four and when multiplied by 1.4 yields a resistance increase depending upon cobalt concentration of approximately five (5) times the normal resistance of solid cobalt. Thus the current required for any amount of total energy required for the welding can be calculated from the formula $I \times I \times R =$ Energy and so has been reduced by the square root of this resistance factor change.

The filigree or strands 63 of cobalt must undergo a plastic deformation to change the shape to the desired gusset shape. Since the energy is supplied directly to the filigree or strands 63, the process can be rapid inasmuch as no time constant is required to heat up cobalt 63 through metallic heat conduction. The positive temperature co-efficient of the resistance of the cobalt also insures uniform heating over the cross section by redistributing the current to the unheated cross section of the rod or tip 60.

Finally the enlargement during the welding process of the gusset 95 at the base of the tip 60 increases the area and decreases the length thereof. This serves to decrease the resistance of the forming area with respect to the rest of the circuit, thereby creating a self limiting feature to help prevent undue melting and enlargement of the gusset 95 beyond its desired configuration and size.

The foregoing welding process has provided longevity of upwards of 3500 continuous printing hours such that the hammerspring welding area has achieved about 3.5 billion impact cycles. There has not been any substantial fatigue or failure rates during such cycles. As a consequence, it is believed that this invention of the combination of the hammersprings 24 and welding of the tungsten carbide printing tips 60 through the cobalt resistance and weldment flow is a substantial step over the art and should be read broadly in light of the following claims.

We claim:

1. The process of making hammersprings for a dot matrix printer wherein said hammersprings are to be attached to a hammerbank frame having a plurality of permanent magnets in said hammerbank frame which retain said hammersprings in adjacent relationship to said permanent magnets until released by means of a current overcoming the force of said permanent magnets wherein the improvement comprises:

forming a plurality of hammersprings from single piece of spring steel wherein said hammersprings are in a continuously connected relationship to each other and formed with a common securement means for attachment thereof to said hammerbank frame;

placing said hammersprings into a fixture in plural relationship;

providing a first electrode in contact with said hammersprings;

providing a tungsten carbide printing tip formed as a rod in adjacent relationship to each of said hammersprings;

holding said tungsten carbide rod in adjacent relationship to said hammersprings;

providing a second electrode in contact with said tungsten carbide rod;

causing a current to flow between said first and second electrodes to cause said tungsten carbide rod to be welded by a flow of cobalt from said rod in an enlarged flow at the interface of said rod and hammerspring and formed as a fillet to said hammersprings;

holding said tungsten carbide rod by means of said second electrode;

providing a chamfer within said second electrode adjacent said tungsten carbide rod and, flowing cobalt into approximate adjacent relationship to said chamfer to form a fillet to reinforce said tungsten carbide rod on said hammersprings.

2. The process as claimed in claim 1 further comprising:

initially preheating said tungsten carbide rods to within the range of forty to sixty percent (40–60%) less than said welding heat;

welding said tungsten carbide rods at a higher heat than said initial preheat;

decreasing said heat from said welding heat at the end of said weld in the range of forty to sixty percent (40–60%) less than the welding heat.

3. A process for welding a tungsten carbide printing tip of a dot matrix printer to a hammerspring comprising:

forming a hammerspring in a desired configuration;

holding said hammerspring in a jig formed in part by a heat sink to remove the heat of welding from said hammerspring;

providing a first electrode in adjacent relationship to said hammerspring;

providing a second electrode in adjacent relationship to a tungsten carbide printing tip formed from a rod having cobalt therein;

forcing said tungsten carbide rod into adjacent relationship with said hammerspring;

providing a welding current between said first and second electrodes in order to cause the cobalt in said tungsten carbide rod to be welded to said hammerspring;

causing a flow of cobalt from said tungsten carbide rod during said welding process to form a fillet adjacent the base of said tungsten carbide rod and said hammerspring; and providing a chamfer in the area adjacent the end of said second electrode to allow the flow of cobalt of said tungsten carbide rod into the area adjacent said second electrode.

* * * * *